US008584389B2

(12) United States Patent
Godard

(10) Patent No.: US 8,584,389 B2
(45) Date of Patent: Nov. 19, 2013

(54) AMMUNITION CARRIER FOR FIREARM STOCK

(76) Inventor: Michael Godard, Melbourne, FL (US)

( * ) Notice: Subject to any disclaimer, the term of this patent is extended or adjusted under 35 U.S.C. 154(b) by 0 days.

(21) Appl. No.: 13/040,960

(22) Filed: Mar. 4, 2011

(65) Prior Publication Data

US 2011/0239514 A1 Oct. 6, 2011

(51) Int. Cl.
*F41C 23/22* (2006.01)

(52) U.S. Cl.
USPC ..... 42/71.01; 42/106

(58) Field of Classification Search
USPC ..... 42/90, 72, 71.01, 106; 206/3; 224/247
See application file for complete search history.

(56) References Cited

U.S. PATENT DOCUMENTS

| | | | | | |
|---|---|---|---|---|---|
| 1,110,209 | A * | 9/1914 | Kirchner | 42/71.01 |
| 1,693,289 | A * | 11/1928 | Warren | 42/71.01 |
| 2,605,033 | A * | 7/1952 | Terry | 224/5 |
| 4,860,478 | A | 8/1989 | Clayton | |
| 5,121,564 | A * | 6/1992 | Story | 42/90 |
| 5,265,365 | A * | 11/1993 | Finn | 42/74 |
| 5,964,054 | A * | 10/1999 | Galfidi, Jr. | 42/90 |
| 6,370,807 | B1 * | 4/2002 | Eisenhut et al. | 42/90 |
| 6,374,719 | B1 * | 4/2002 | Phillips | 89/34 |
| 6,874,618 | B1 * | 4/2005 | Cragg | 206/3 |
| 7,503,137 | B2 * | 3/2009 | Filicietti | 42/71.01 |
| 7,540,107 | B2 * | 6/2009 | Oum | 42/71.01 |
| 2004/0060220 | A1 * | 4/2004 | Peddie | 42/71.01 |
| 2008/0000131 | A1 * | 1/2008 | Oum | 42/71.01 |

* cited by examiner

*Primary Examiner* — Jonathan C Weber

(57) ABSTRACT

An ammunition carrier for attaching one or more cartridges to a firearm. The ammunition carrier may comprise a base member for securing the carrier to the stock of a firearm such as a long gun and a cartridge holder for releasably retaining one or more cartridges within a plurality of cartridge storage loops. A releasable connection between the base member and the cartridge holder allows for the cartridge holder and the cartridges held therein to be quickly and easily removed from the stock of the firearm such as when the firearm is to be placed in a case for storage or transport. A cover may also be associated with the ammunition carrier for covering at least a portion of the one or more cartridges and the cover is at least partially moveable to permit selective removal of the one or more cartridges.

3 Claims, 3 Drawing Sheets

AMMUNITION CARRIER FOR FIREARM STOCK

CROSS REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The invention pertains to an ammunition carrier for firearm cartridges and more particularly to an ammunition carrier for firearms including but not limited to long guns such as rifles and shotguns.

2. Background Art

Through the years, many attachments and accessories have been developed for firearms including long guns such as rifles and shotguns. These include a myriad of forms of stocks and butt pads, telescopic and other improved sights as well as stocks with adjustable cheek pieces. Many of these, to an extent, improve the operation of the long gun. Additionally, many types of gun cases and covers have been developed from the hard sided fitted case to the flexible lined case to simple stock covers. The purpose of these covers is, of course, to protect the long gun from damage in storage or transit.

The development of firearms has proceeded over many years from single action or shot devices to automatic devices having facilities for many rounds of ammunition.

Notwithstanding the advance in firearms and their construction, there remain many single action firearms, and sales of such devices are still significant for the recreational hunter. Even professional hunters in the North often have or prefer single action devices.

A common single action firearm is the .22 caliber rifle.

Although ammunition carriers worn as a belt or shoulder harness are known and provide for an orderly array of ammunition to be selectively used in loading and firing the gun, it would be advantageous to have a simple device for holding ammunition on or associated with part of the gun itself. Such a device is provided by the present invention and is structurally sound yet simple in operation and non-obstructive to the user.

BRIEF SUMMARY OF THE INVENTION

The present invention comprises a system and/or method that has one or more of the following features and/or steps, which alone or in any combination may comprise patentable subject matter.

Accordingly, applicant's invention pertains to an ammunition carrier adapted for fixed association with the stock of a gun or firearm and which provides means for holding a plurality of individual cartridges relatively securely and yet providing for easy access to the cartridges and easy removal from the carrier.

In accordance with one embodiment of the present invention, the invention may comprise an ammunition carrier for a firearm, comprising a cartridge holder, wherein the cartridge holder comprises a plurality of cartridge storage loops and the cartridge holder is releasably attachable to the firearm.

Other aspects of the present invention may further comprise a base member fixed to the firearm, wherein the base member is disposed between the firearm and the cartridge holder, wherein the base member is fixed to the firearm with an adhesive, and wherein a first releasable surface on said base member provides a releasable connection with a second releasable surface on said cartridge holder. The present invention may still further comprise a cover, wherein at least a portion of said cover releasably overlays said cartridge holder.

It is another aspect of the invention to provide an ammunition carrier of the type described that can be secured to firearms and/or stock of firearms of a variety of brands and styles.

It is a further aspect of the invention to provide an ammunition carrier that will retain cartridges in a spaced-apart, easy-to-grasp relationship where they cannot scratch or otherwise cause damage to one another or the firearm. While retained, certain embodiments of the present invention may also isolate the cartridges from dust and dirt.

It is a further aspect of the invention to provide an ammunition carrier that may be easily and efficiently removed from the firearm when the firearm is to be placed into its case for storage or transport.

It is a still further aspect of the invention to provide improved elements and arrangements thereof in an ammunition carrier for the purposes described that is lightweight in construction, inexpensive to manufacture, and dependable in use.

The foregoing and other aspects, features and advantages of the present invention will become readily apparent upon further review of the following detailed description of the preferred embodiment as illustrated in the accompanying drawings.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

Figure 1:
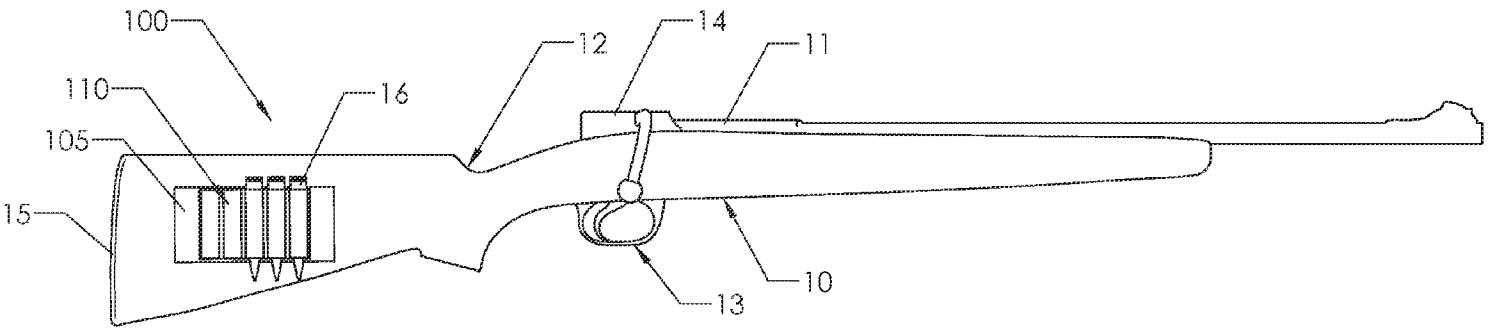
FIG. 1 depicts a front view of a rifle having one embodiment of an ammunition carrier of the present invention installed thereon.

Although a detailed description as provided in the attachments contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

Now referring to FIGS. 1-7, a conventional firearm 10 such as a rifle may be seen with a barrel 11, a stock 12, trigger assembly 13 and a bolt action 14. The stock 12 may further include a butt plate 15 that rests against the shooter's shoulder when in a firing position. The ammunition carrier 100 of the present invention may preferably be attached to a side surface of the stock 12.

Figure 2:
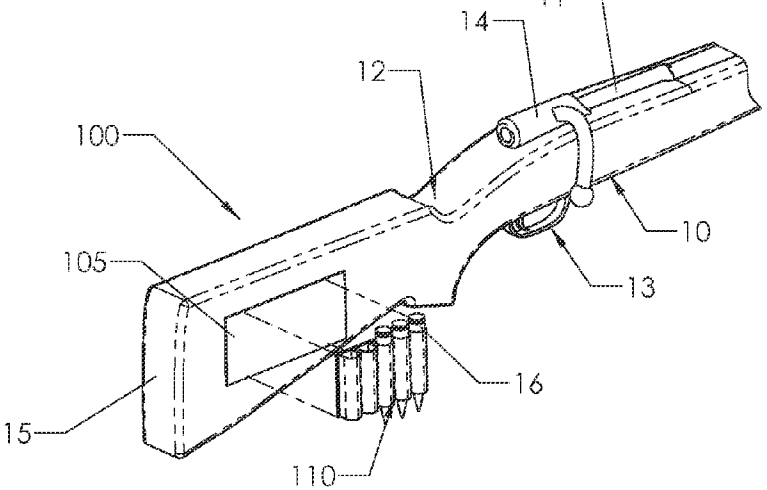
FIG. 2 depicts a fragmentary perspective view of the same embodiment shown in FIG. 1 wherein the cartridge holder and the base member of the ammunition carrier of the present invention have been releasably separated.

Now referring to FIG. 1, the ammunition carrier 100 is shown and may generally comprise a base member 105 and a cartridge holder 110 that may be fixed to a firearm 10. As shown in FIG. 2, a releasable connection may be provided between the base member 105 and the cartridge holder 110 allowing for the cartridge holder 110 to be quickly and easily removed from the base member 105 that remains on the firearm 10 or stock 12 such as when the firearm 10 is placed into its case for storage or transport. Subsequent use of the ammunition carrier 100 simply involves re-establishing the releasable connection between the base member 105 and the cartridge holder 110 when the firearm 10 is taken out of its case to be used again (as shown in FIG. 1).

FIGS. 1-2 illustrate that a preferred embodiment for the base member 105 is a rectangular in shape, although any shape of the base member 105 is within the scope of the present invention. The base member 105 of the present invention may easily be changed or adjusted to fit a variety of firearms 10 and/or stocks 12. As more easily seen in FIGS. 3-7, the base member 105 may comprise a fixation surface that is secured to the firearm 10 or stock 12. In a preferred embodiment the base member 105 may be fixed to the firearm 10 or stock 12 by means of any adhesives known within the art. In the most preferred embodiment, the selected adhesive may provide secure fixation while not harming or damaging the stock 12 of the firearm 10. Alternatively, the base member 105 may be fixed to the firearm 10 or stock 12 by any fastener means known within the art including but not limited to rivets, nails, screws, and the like. The base member 105 further comprises a first releasable surface 106 that provides a releasable connection with the cartridge holder 110. In a preferred embodiment, the base member 105 may comprise a flat structure having the fixation surface on the firearm-facing side wherein the first releasable surface 106 is disposed on the opposite outward-facing side of the base member 105 structure.

Figure 3:
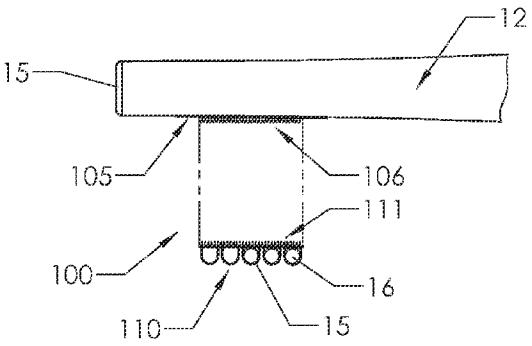
FIG. 3 depicts a fragmentary top view of an embodiment of an ammunition carrier of the present invention.

As generally shown in FIGS. 1-2, the cartridge holder 110 is releasably connected to the firearm 10 or stock 12 at a releasable connection with the base member 105. More specifically, as best shown in FIG. 3 the releasable connection may be formed between the first releasable surface 106 of the base member 105 and a second releasable surface 111 of the cartridge holder 110. The cartridge holder 110 may further comprise a plurality of cartridge storage loops 115. While the scope of the present invention includes the use of any number of cartridge storage loops 115, preferred embodiments may comprise six (6) or ten (10) loops for use with rifle cartridges and five (5) loops for use with shotgun shells. The plurality of cartridge storage loops 115 may be constructed from material that may provide either a non-stretchable friction-fit for cartridges having specifically-sized diameters (e.g. .22 caliber, shotgun shells, etc.) or a stretchable material that provides a friction fit on the respective cartridges by means of the stretchable bias of the resilient and stretchable material.

The releasable connection formed between the first releasable surface 106 of the base member 105 and the second releasable surface 111 of the cartridge holder 110 may take a variety of forms. In a preferred embodiment, the first releasable surface 106 and the second releasable surface 111 may comprise complimentary hook and loop fasteners, commonly sold under the trademark VELCRO, thereby forming a releasable connection that may easily separate or reconnect the base member 105 and the cartridge holder 110 as needed. Alternate embodiments and the scope of the present invention further include any releasable connections known within the art including but not limited to a zipper connections, snap fasteners, complimentary latch structures, and the like.

As shown in FIGS. 4-7, the ammunition carrier 100 of the present invention may further comprise a cover 120 for overlapping and protecting the one or more ammunition cartridges from dirt and environmental elements. The cover 120 may be secured to either the cartridge holder 110 (see FIGS. 4-5) or the base member 105 (see FIGS. 6-7) by at least a first attachment point 125 and a second attachment point 126.

Figure 4:
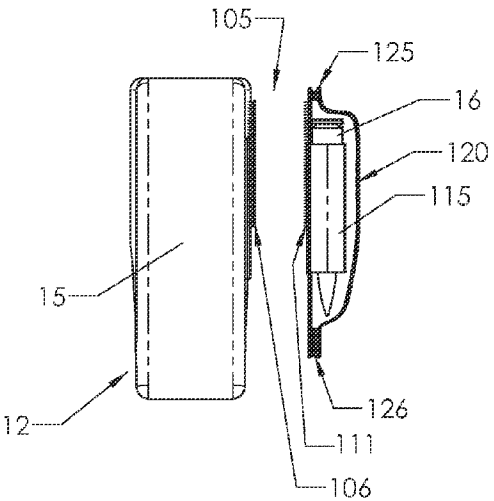
FIG. 4 depicts a side view of an embodiment of the ammunition carrier of the present invention wherein a cover member is in the closed position.
Figure 5:
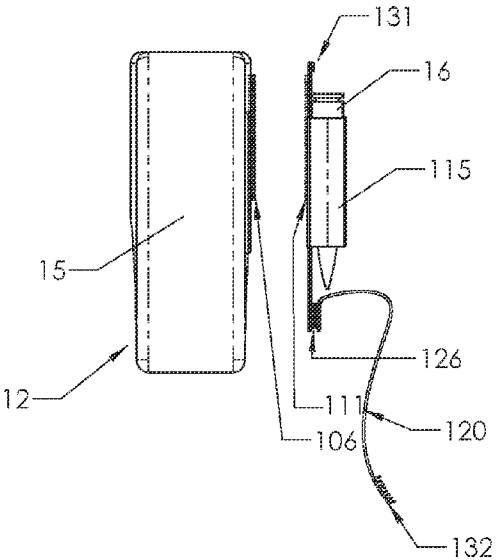
FIG. 5 depicts a side view of the embodiment of the ammunition carrier of the present invention in FIG. 4 wherein the cover member is in the open position.

FIGS. 4-5 depict an embodiment where the cover 120 is attached to the cartridge holder 110 by at least a first attachment point 125 and a second attachment point 126. The exemplary embodiment depicted in FIGS. 4-5 comprises a releasable first attachment point 125 comprising complimentary hook and loop fasteners 131,132 and a fixed second attachment point 126 comprising a stitched joint between the cover 120 and the cartridge holder 110. In the present configuration, when the first attachment point 125 is released, the cover 120 will naturally hang down and not obstruct the plurality of cartridge storage loops 115. The type of connection structure at each of the first attachment point 125 and the second attachment point 126 may be independently selected from the group including but not limited to complimentary hook and loop fasteners, snap fasteners, complimentary latch structures, one or more zippers, stitching, and the like. If both the first attachment point 125 and the second attachment point 126 comprise releasable connections, the cover 120 may be temporarily and completely removed when it is not needed (not shown). If only one of the first attachment point 125 and the second attachment point 126 is a releasable connection, the cover 120 may be at least partially movable when the connection is released thereby allowing access to the plurality of cartridge storage loops 115 as needed (see exemplary FIG. 5).

Figure 7:
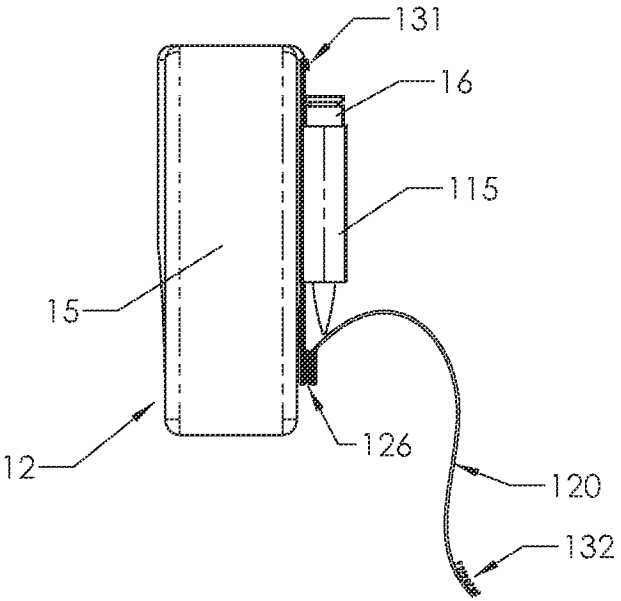
FIG. 7 depicts a side view of the embodiment of the ammunition carrier of the present invention in FIG. 6 wherein the cover member is in the open position.
Figure 6:
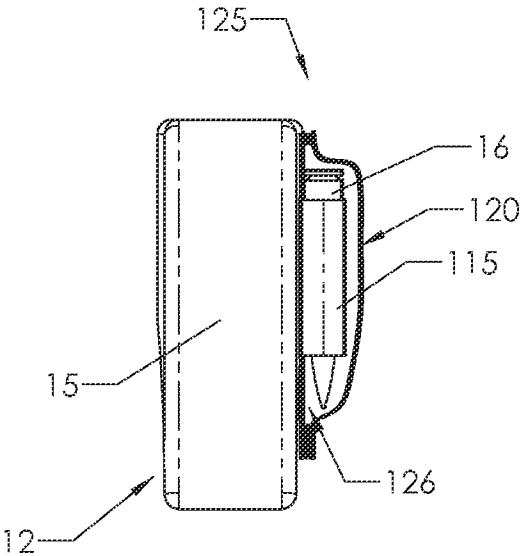
FIG. 6 depicts a side view of another embodiment of the ammunition carrier of the present invention wherein the cover member is in the closed position.

FIGS. 6-7 depict an embodiment where the cover 120 is attached to the base member 105 by at least a first attachment point 125 and a second attachment point 126. The exemplary embodiment depicted in FIGS. 6-7 comprises a releasable first attachment point 125 comprising complimentary hook and loop fasteners 131,132 and a fixed second attachment point 126 comprising a stitched joint between the cover 120 and the base member 105. In the present configuration, when the first attachment point 125 is released, the cover 120 will naturally hang down and not obstruct the cartridge holder 110 and the plurality of cartridge storage loops 115. The type of connection structure at each of the first attachment point 125 and the second attachment point 126 may be independently selected from the group including but not limited to complimentary hook and loop fasteners, snap fasteners, complimentary latch structures, one or more zippers, stitching, and the like. If both the first attachment point 125 and the second attachment point 126 comprise releasable connections, the cover 120 may be temporarily and completely removed when it is not needed (not shown). If only one of the first attachment point 125 and the second attachment point 126 is a releasable connection, the cover 120 may be at least partially movable when the connection is released thereby allowing access to the plurality of cartridge storage loops 115 as needed (see exemplary FIG. 7).

The construction of the ammunition carrier 100 is such that comfortable and easy hand and finger movement enables one or more cartridges 16 to be extracted from the plurality of cartridge storage loops 115. After the last cartridge 16 is extracted, the ammunition carrier 100 may be replenished with cartridges 16 as needed.

In one embodiment of use, the base member 105 may first be fixed to a firearm 10 or the stock 12 of a firearm 10. The cartridge holder 110 may then be releasably mounted on or connected to the base member 105 when the first releasable surface 106 of the base member 105 interacts with the second releasable surface 111 of the cartridge holder 110. The cartridge holder 110 may thereafter be removed from the base member 105 and the stock 12 of the firearm 10 as needed by grasping and pulling outward on an edge of the cartridge holder 110 or on tabs that may be provided and incorporated about one or more edges of the cartridge holder 110 to facilitate grasping and thereafter separation of the cartridge holder 110 from the base member 105. Such a manual outward pulling by the user will cause the first releasable surface 106 of the base member 105 to disengage from the second releasable surface 111 of the cartridge holder 110 allowing the one or more cartridges 16 within the cartridge holder 110 to be smoothly separated from the stock 12 of the firearm 10. In a preferred embodiment the releasable connection may comprise complimentary hook and loop fasteners, however, snap fasteners and any other known releasable connection known within the art are within the scope of the present invention.

After use, the cartridge holder 110 may be cleaned, if necessary, by rinsing with water and, then, stored or transported in a flat, relatively compact condition away from the stock 12 or on the stock 12 of the firearm 10 and ready for reuse. For many hunters, difficulties in transporting and loading ammunition will be a thing of the past.

The foregoing describes the best mode known by this inventor in carrying out his invention and the embodiments shown are by way of illustration and not limitation. It is recognized that one skilled in the art might vary from the embodiments here illustrated without departing from the principle and concept of the invention.

What is claimed is:

1. An ammunition carrier for a firearm, comprising:

a cartridge holder that is releasably attachable to a firearm, wherein said cartridge holder comprises a plurality of cartridge storage loops with each of said plurality of cartridge storage loops being formed and separated from adjacent loops by stitching, said cartridge holder being further defined as having a top and a bottom, said top being defined as the direction from which cartridges are inserted into said cartridge storage loops and said bottom being defined as an opposite direction from said top; and a base member fixed to said firearm, wherein said base member is disposed between said firearm and said cartridge holder; and a cover attached to said cartridge holder by an upper releasable attachment point and a lower attachment point, wherein said upper releasable attachment point is disposed at said top of said cartridge holder and said lower attachment point is disposed at said bottom of said cartridge holder, and wherein at least a portion of said cover releasably overlays said cartridge storage loops when said cover is attached to said cartridge holder at said upper releasable attachment point;

wherein a first releasable surface on said base member provides a releasable connection with a second releasable surface on said cartridge holder and said first releasable surface and said second releasable surface comprise complimentary hook and loop fasteners.

2. The ammunition carrier of claim 1, wherein said upper releasable attachment point is further defined as comprising an attachment means selected from the group consisting of hook and loop fasteners, snap fasteners and a zipper, and wherein said lower attachment point is further defined as a releasable attachment point comprising an attachment means selected from the group consisting of hook and loop fasteners, snap fasteners and a zipper.

3. The ammunition carrier of claim 1, wherein said upper releasable attachment point is further defined as comprising an attachment means selected from the group consisting of hook and loop fasteners, snap fasteners and a zipper, and wherein said lower attachment point comprises stitching.

* * * * *